US010799428B2

(12) United States Patent
Gastle et al.

(10) Patent No.: US 10,799,428 B2
(45) Date of Patent: Oct. 13, 2020

(54) TRANSFORMABLE TEETHING TOY

(71) Applicant: Mattel, Inc., El Segundo, CA (US)

(72) Inventors: Kevin Gastle, Boston, NY (US); Patrick Joseph Murphy, East Aurora, NY (US); Benjamin M. Cerny, Snyder, NY (US); Santiago Acevedo, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 225 days.

(21) Appl. No.: 15/969,165

(22) Filed: May 2, 2018

(65) Prior Publication Data

US 2019/0336404 A1 Nov. 7, 2019

(51) Int. Cl.
*A61J 17/02* (2006.01)
*A63H 33/00* (2006.01)

(52) U.S. Cl.
CPC ..... *A61J 17/02* (2013.01); *A63H 33/00* (2013.01)

(58) Field of Classification Search
CPC ..... A61J 17/02; A63H 33/00; A63H 33/26; A63H 33/006
See application file for complete search history.

(56) References Cited

U.S. PATENT DOCUMENTS

| | | | | | |
|---|---|---|---|---|---|
| 3,218,071 | A * | 11/1965 | Richard | A63B 43/00 | 473/594 |
| 5,902,322 | A * | 5/1999 | Scagliotti | A61J 17/02 | 606/235 |
| D417,914 | S * | 12/1999 | Nowak | D24/194 | |
| D421,125 | S * | 2/2000 | Nowak | A63B 43/00 | D24/194 |
| 6,863,588 | B1 * | 3/2005 | Chu | A63B 43/00 | 446/46 |
| 7,914,405 | B1 * | 3/2011 | Scheffler | A01K 15/026 | 119/707 |
| 10,300,346 | B2 * | 5/2019 | Hinnen, III | A63B 43/002 | |
| 2008/0215092 | A1 * | 9/2008 | Smith | A61J 17/001 | 606/236 |
| 2009/0112260 | A1 * | 4/2009 | Renko | A61J 17/02 | 606/235 |

* cited by examiner

*Primary Examiner* — Julian W Woo
(74) *Attorney, Agent, or Firm* — Edell, Shapiro & Finnan, LLC

(57) ABSTRACT

A transformable teething toy comprising a first hub and a second hub. Resilient flexible rods connect the first hub to the second hub such that the inner surfaces of the first and second hubs are oriented to face towards each other. The teething toy is further transformable between an open position and a closed position. In the open position, the first and second hubs are spaced apart from each other by the resilient flexible rods to form an expanded structure. In the closed position, the resilient flexible rods are bent such that the expanded structure is collapsed and the inner surfaces of the first and second hubs are releasably engaged with each other.

17 Claims, 7 Drawing Sheets

TRANSFORMABLE TEETHING TOY

FIELD OF THE INVENTION

The present invention relates generally to infant and toddler toys and accessories, and in particular teethers and teething toys.

BACKGROUND OF THE INVENTION

An infant begins teething when the infant's first set of teeth, known as primary teeth, start to break through the gums and emerge. During this time, the infant may have sore or tender gums due to the pressure of an emerging tooth beneath the gums. This soreness or tenderness may be temporarily relieved by providing counter-pressure and/or friction to the gums. Teethers have been created that an infant can chew on to help soothe the gums during the teething process.

Even though teethers are currently available in various forms and materials, there is a need for a teething toy that an infant or toddler can continue to enjoy and play with even after the teething stage. Thus, a teething toy that provides learning and entertainment features for children in different developmental stages is desirable.

SUMMARY OF THE INVENTION

The present invention provides a teething toy with resilient flexible rods that a teething infant can chew on. Furthermore, the teething toy can be manually transformed between an expanded structure and a collapsed structure, which provides additional stimulation of the senses and promotes the development of motor skills. This transformable feature of the teething toy offers extended entertainment and play value even when the child is past the teething stage. Typical teethers in the art are discarded when a child has grown past the teething stage. In contrast, the appeal and playability of the present teething toy for older children (such as toddlers) gives the teething toy a longer playable lifespan and added value.

According to one aspect of the present invention, a teething toy is provided. The teething toy comprises a first hub and a second hub, with each hub having an outer cover and an inner surface. A plurality of resilient flexible rods connects the first hub to the second hub such that the inner surface of the first hub is positioned towards the inner surface of the second hub. The teething toy is transformable between an open position where the first and second hubs are spaced apart from each other and a closed position where the inner surfaces of the first and second hubs are releasably engaged with each other.

The teething toy transforms from the open position to the closed position when the first and second hubs are pushed towards each other such that the inner surfaces of the first and second hubs engage with each other. Additionally, the teething toy transforms from the closed position to the open position when the first and second hubs are pulled away from each other, thereby disengaging the inner surfaces of the first and second hubs and allowing the resilient flexible rods to push and space apart the first and second hubs. Further, the resilient flexible rods cause the first hub and/or second hub to rotate as the teething toy transforms between the open and closed positions. This is due to the resilient flexible rods exhibiting less resistance when twisted into a flat helical shape rather than being bent in half.

In one or more embodiments, the resilient flexible rods are curved and the teething toy is a spherical or hemispherical structure in the open position. In further embodiments, the first and second hubs are circular and the resilient flexible rods connect near the circumferences of the first and second hubs. In one instance, the transformable teething toy comprises five resilient flexible rods with each rod having a different surface texture.

In other embodiments, the inner surfaces of the first and second hubs are uneven and complementarily engage with each other in the closed position. In one instance, the first hub and/or the second hub comprises a magnet and the first hub magnetically engages with the second hub while in the closed position.

In another aspect of the present invention, a method of transforming a teething toy is provided. The method comprises providing a transformable teething toy comprising a first hub, a second hub, and a plurality of resilient flexible rods connecting the first hub to the second hub. The first and second hubs each have an outer cover and an inner surface. The teething toy is transformed by moving the first hub and second hub towards or away from each other to switch between an open position where the first and second hubs are spaced apart from each other and a closed position where the inner surfaces of the first and second hubs are releasably engaged with each other. The resilient flexible rods cause the first hub and/or second hub to rotate while the teething toy is transformed between the open and closed positions.

Other objects, features, and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout:

FIG. 1A provides a top perspective view, FIG. 1B provides a top view, FIG. 1C provides a bottom perspective view, and FIG. 1D provides a side view;

FIGS. 2A-B provide side perspective views of the teething toy twisted in a clockwise (FIG. 2A) and counter-clockwise (FIG. 2B) direction. FIGS. 2C-D provide top perspective views of the teething toy twisted in the clockwise (FIG. 2C) and counter-clockwise (FIG. 2D) direction.

DETAILED DESCRIPTION OF THE INVENTION

A transformable teething toy according to the present invention provides teether functions as well as engaging entertainment for infants and toddlers alike. In a general embodiment, the teething toy comprises a first hub and a second hub, each having an outer cover and an inner surface.

One or more resilient flexible rods connect the first hub to the second hub. The teething toy is further transformable between an open position and a closed position. In the open position, the first and second hubs are spaced apart by the resilient flexible rods to form an expanded structure. In the closed position, the resilient flexible rods are bent such that the expanded structure is collapsed and the inner surfaces of the first and second hubs are releasably engaged with each other.

Referring to FIGS. 1A-D, a teething toy 100 in accordance with one or more embodiments of the invention is shown. The teething toy 100 has a first hub 102 and a second hub 108 that a child can grab onto when interacting and playing with the teething toy 100. In this exemplary embodiment, the hubs 102, 108 are plastic circular hubs. The hubs may also be made of other materials, such as wood, metal, rubber, silicone, polymer or combinations thereof. Furthermore, other embodiments of the invention include hubs having different combinations of colors, textures, decorations, shapes, etc., which can provide enhanced appeal and/or sensory stimulation to a child.

Figure 1A:
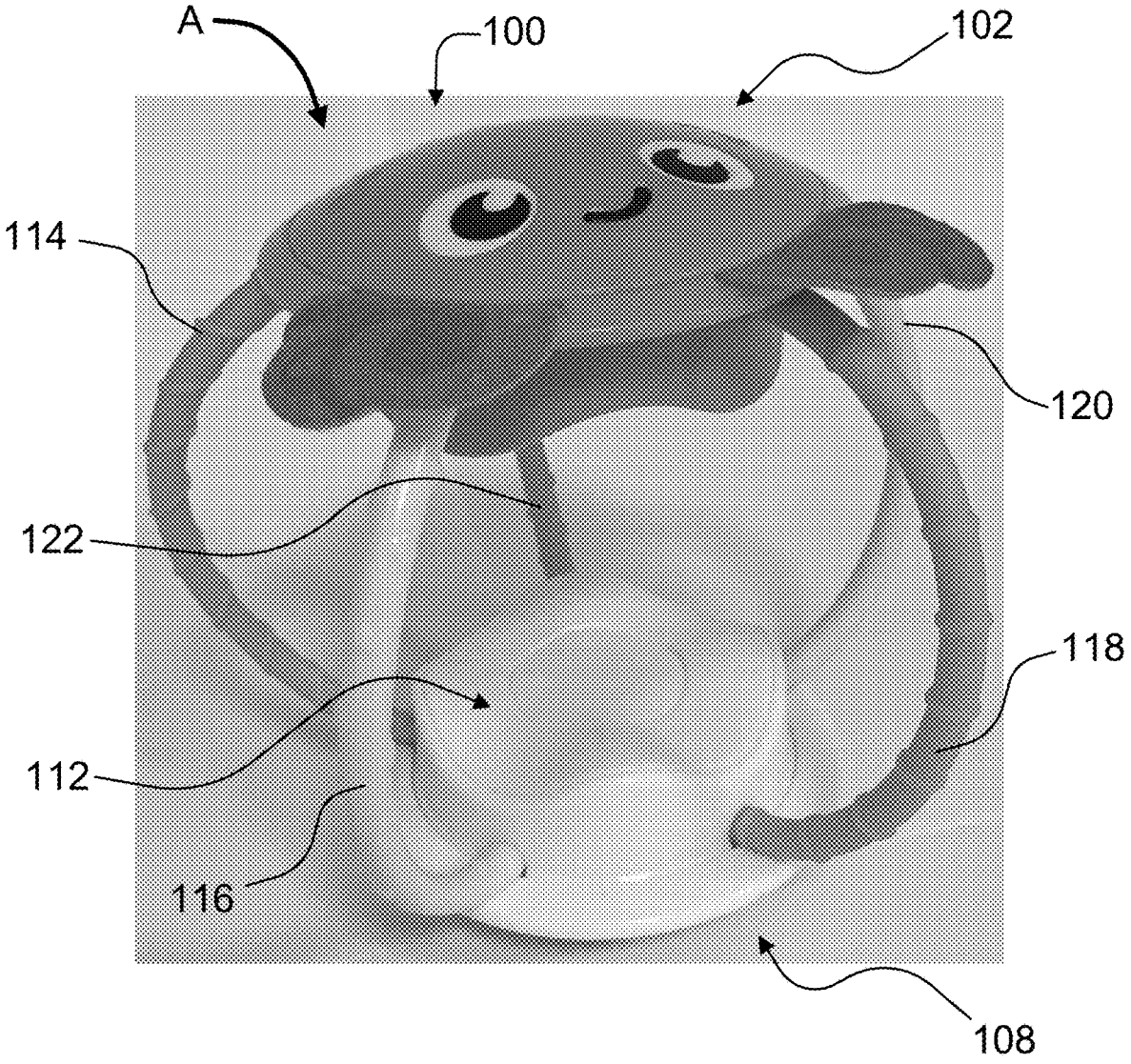
FIGS. 1A-D illustrate various views of a teething toy in an open position, in accordance with one embodiment of the invention.
Figure 1B:
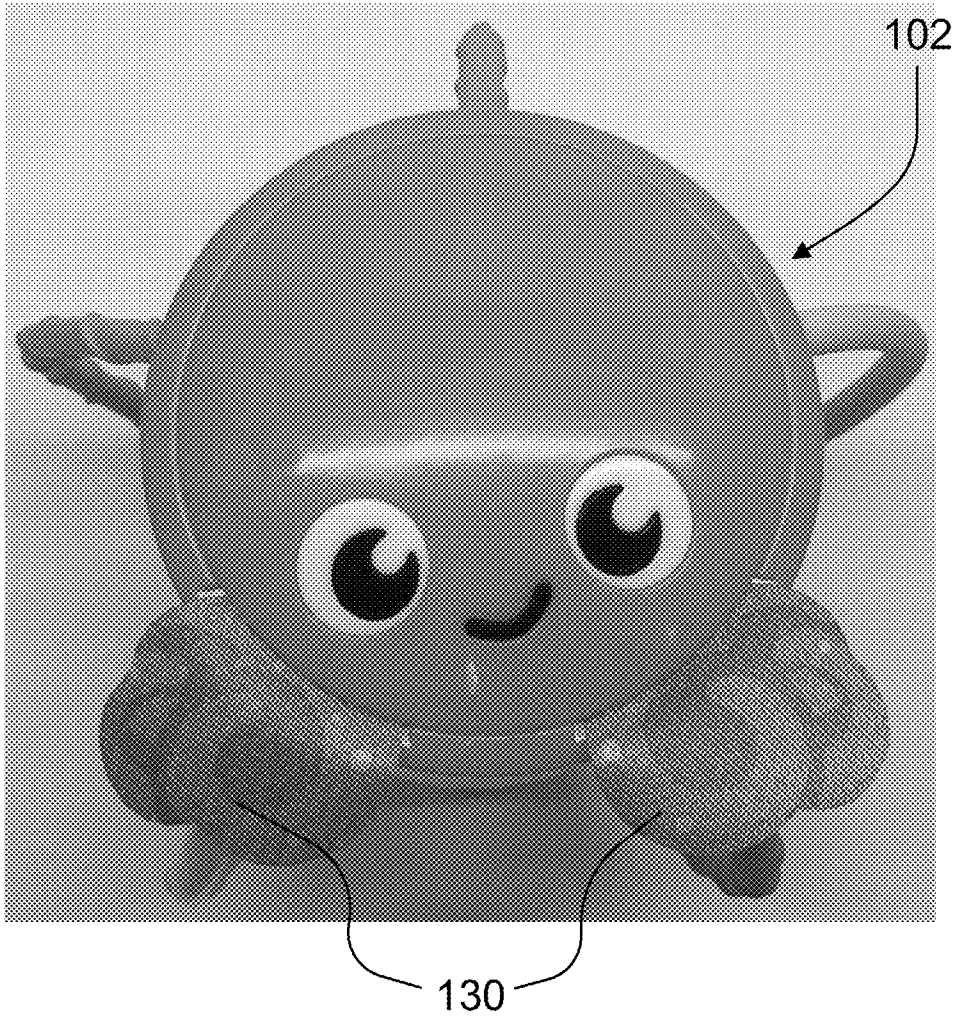
Figure 1C:
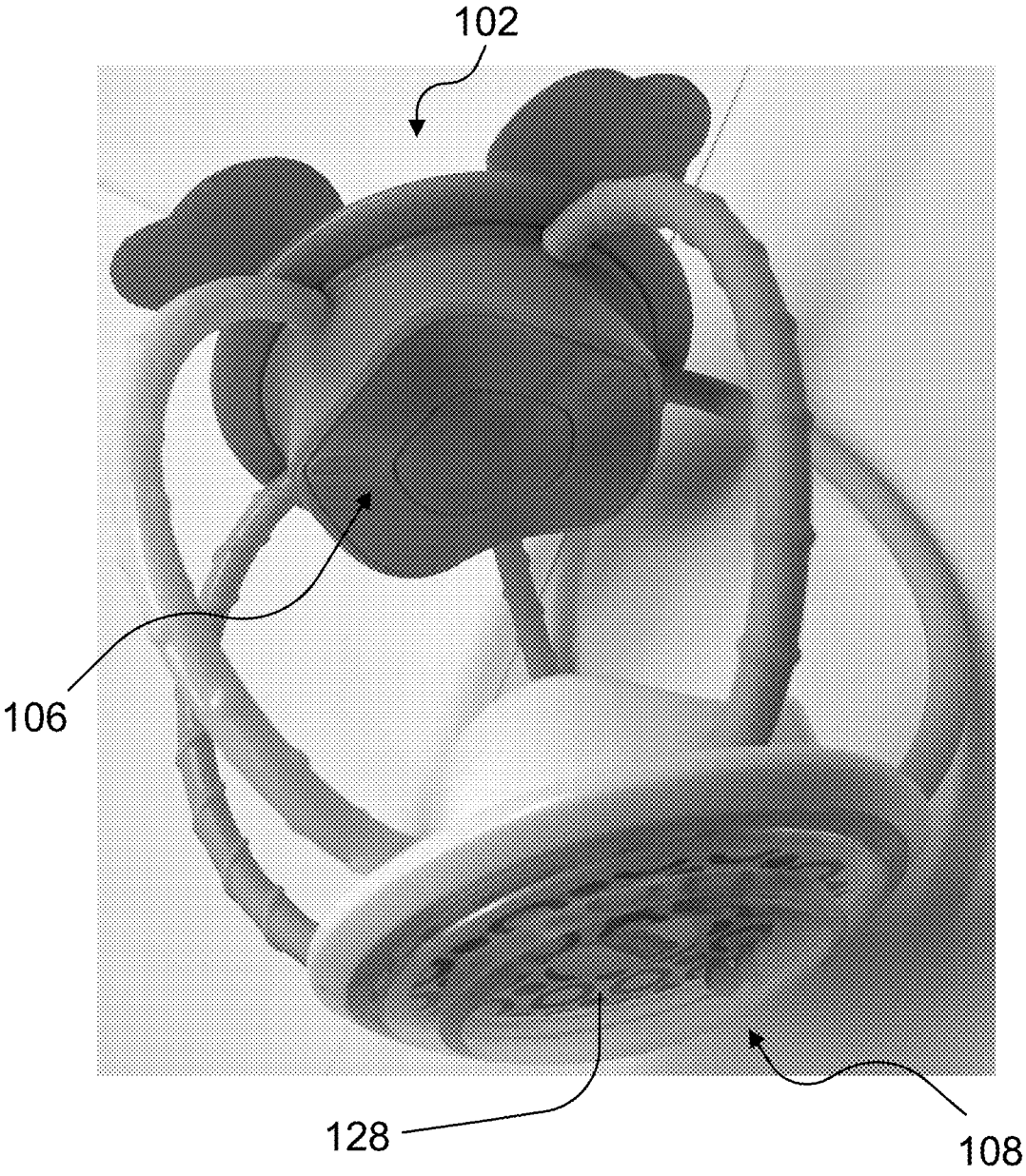

Additional accessories and sensory elements may further be attached to the hubs 102, 108 or form part of the hubs 102, 108. For instance, the first hub 102 includes two pieces of fabric 130 (see, e.g., FIG. 1B) that provide a child with additional tactile stimulation. As shown in FIG. 1C, the second hub 108 includes beads in a hollow chamber that form a rattle 128. Other examples of accessories and sensory elements that may be included with the hubs 102, 108 include beads, strings, mirrors, fabric, rattles, crinkle material, dials, squeakers, speakers, lights, clips, wheels, clickers, other fidget devices, etc.

Figure 1D:
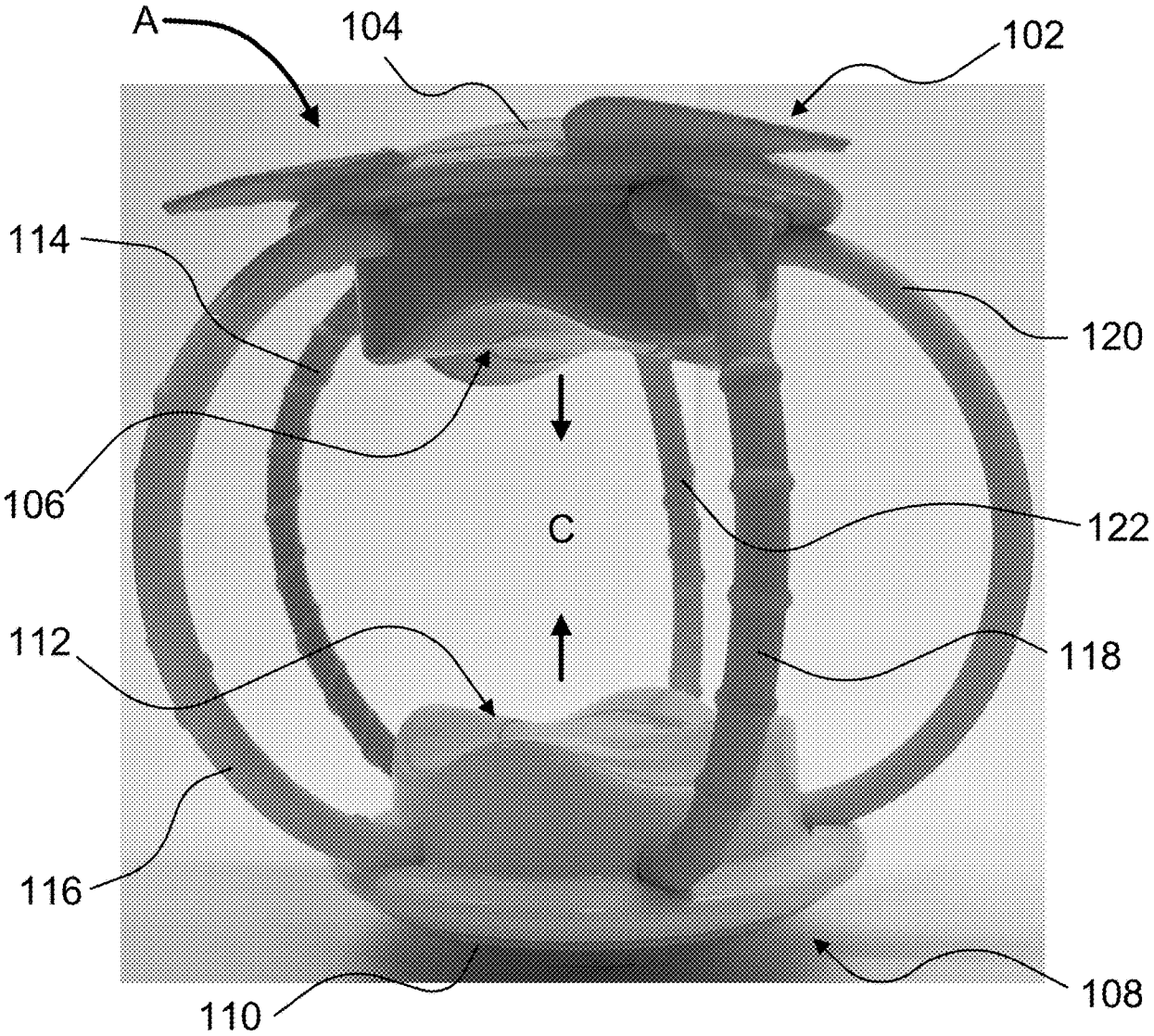

As shown in FIG. 1D, the first hub 102 has an outer cover 104 and an inner surface 106. Similarly, second hub 108 has an outer cover 110 and an inner surface 112. In one or more embodiments, the outer covers 104, 110 have convex curvatures that allow the teething toy 100 to roll around like a ball while in an open position A (see, e.g., FIG. 1D). In further embodiments, the inner surfaces 106, 112 are uneven and complementarily engage with each other while the teething toy 100 is in a closed position B (see, e.g., FIG. 2A). In yet other embodiments, the outer covers and/or the inner surfaces of the hubs are flat.

Referring back to FIGS. 1A and 1D, the teething toy 100 has multiple resilient flexible rods 114-122 that connect the first hub 102 to the second hub 108. Though five flexible rods are shown (i.e., flexible rods 114, 116, 118, 120, and 122), embodiments of the invention include any number of flexible rods (e.g., 1, 2, 3, 4, 6 or 8 rods). The flexible rods 114-122 are made from a flexible and resilient material that a teething infant can chew on. Thus, the flexible rods 114-122 preferably have a durometer that is suitable as a teether element. It is also desirable that the flexible rods 114-122 do not contain any toxic chemicals that a child may possibly ingest while chewing on the flexible rods 114-122. In a preferred embodiment, the flexible rods 114-122 are made from silicone or thermoplastic elastomers (TPE). In other embodiments, the flexible rods 114-122 are made from rubber or ethylene vinyl acetate (EVA). Typically, the flexible rods 114-122 are solid pieces, though in some embodiments, the flexible rods are filled with a fluid or gel that can be frozen or refrigerated.

The flexible rods 114-122 have textured surfaces for soothing and stimulating an infant's gums. In one embodiment, each flexible rod has a different surface texture (e.g., embossing, bumps, lines, etc.). For example, as shown in FIG. 1D, flexible rod 114 has a glossy surface with a raised helical texture; flexible rod 116 has a glossy surface with raised bumps; flexible rod 118 has a matte surface with raised rings; flexible rod 120 has a flat matte surface; and flexible rod 122 has a matte surface with raised bumps. In other embodiments, some or all of the flexible rods have similar surface textures.

The flexible rods 114-122 position the hubs 102, 108 such that the inner surface 106 of the first hub 102 faces the inner surface 112 of the second hub 108. Furthermore, the flexible rods 114-122 are outwardly curved such that the teething toy 100 has a generally spherical expanded structure while in the open position A (see, e.g., FIGS. 1A-D). The ability of the resilient flexible rods 114-122 to deform and return to their original shape allows the teething toy 100 to transform back and forth between the open position A and the closed position B (see, e.g., FIGS. 2A-C). The resilient nature of the flexible rods 114-122 also provides elastic qualities to the teething toy 100 when it is bounced around or compressed, especially when in the open position A or when it serves as a ball for an older child. Embodiments of the invention also include the teething toy having an expanded structure in other geometries and shapes, such as a hemisphere, cylinder, cube, cuboid, cone, prism, pyramid, polygon, torus, or ellipsoid.

The teething toy 100 is transformable between the open position A (where the first and second hubs 102, 108 are spaced apart from each other) and the closed position B (where the inner surfaces 106, 112 of the first and second hubs 102, 108 are releasably engaged with each other). As shown in FIG. 1D, the teething toy 100 transforms from the open position A to the closed position B when the first and second hubs 102, 108 are pushed towards each other in the direction of the arrows C until the inner surfaces 106, 112 of the first and second hubs 102, 108 engage with each other.

In one or more embodiments, the resilient flexible rods 114-122 cause the first hub 102 and/or second hub 108 to rotate as the teething toy 100 transforms between the open and closed positions. The hubs 102, 108 may naturally rotate as a child pushes the two hubs 102, 108 together or the child may consciously twist one or both of the hubs 102, 108 while moving them together. Preferably, the resilient flexible rods 114-122 prevent the hubs 102, 108 from engaging with each other if the child tries to push them directly towards each other without any rotation. If a child tries to push the hubs 102, 108 directly towards each other without any rotation, the resilient nature of the flexible rods 114-122 generates resistance against the stress subjected on the flexible rods 114-122. This resistance increases as the two hubs 102, 108 are pushed closer together. The resistance continues to build up until the child can no longer push the hubs 102, 108 closer together or the hubs 102, 108 rotate. The hubs 102, 108 have a natural tendency to rotate as they come together because the flexible rods 114-122 offer less resistance when they are flattened in a twisted helical shape as opposed to being bent in half (i.e., bent end to end).

Figure 2A:
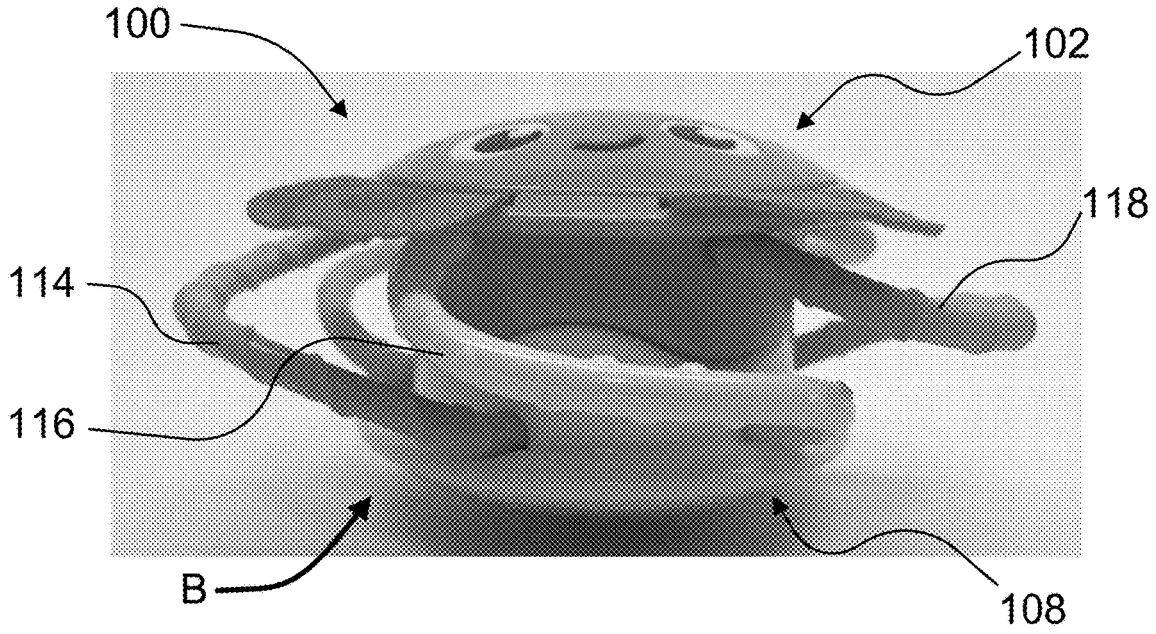
FIGS. 2A-C illustrate various views of the teething toy of FIGS. 1A-D in a closed position.
Figure 2B:
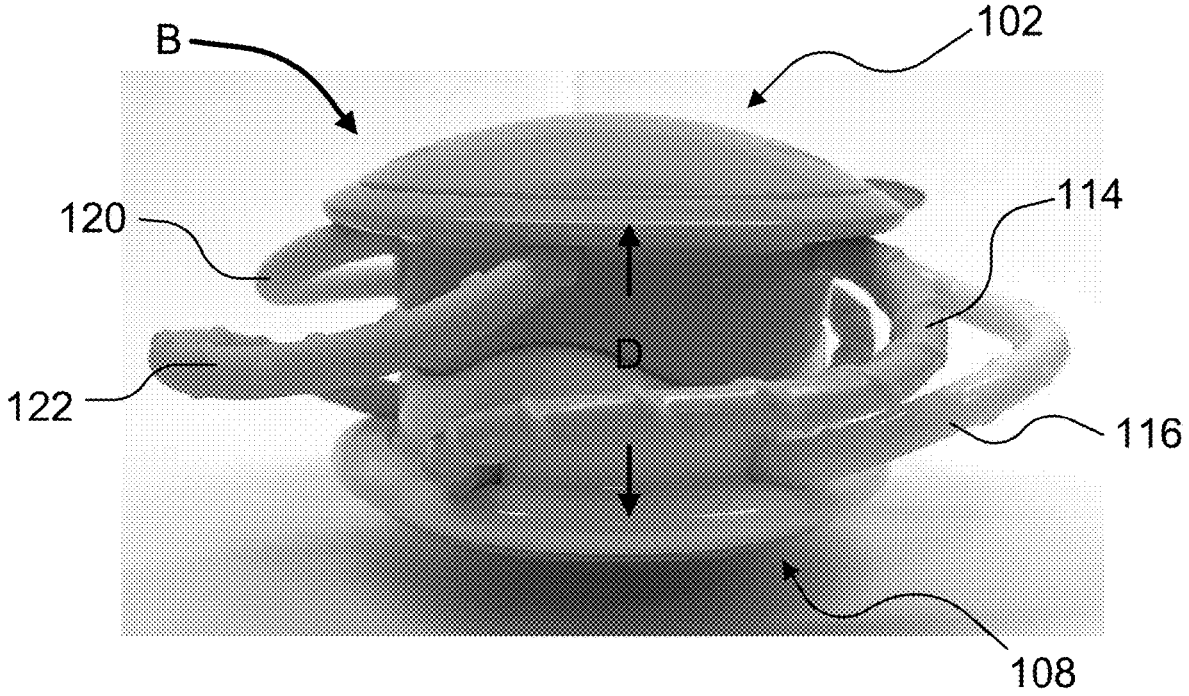

When transforming the teething toy 100, the hubs 102, 108 rotate in opposite directions (e.g., first hub 102 rotates clockwise while the second hub 108 rotates counter-clockwise). This transformation can occur in either direction. For example, FIG. 2A shows the teething toy 100 in the closed position B where the flexible rods 114-122 are bent in a clockwise direction. FIG. 2B shows the teething toy 100 in the closed position B where the flexible rods 114-122 are bent in a counter-clockwise direction instead. In both configurations, the first hub 102 is releasably engaged with the second hub 108.

Figure 2C:
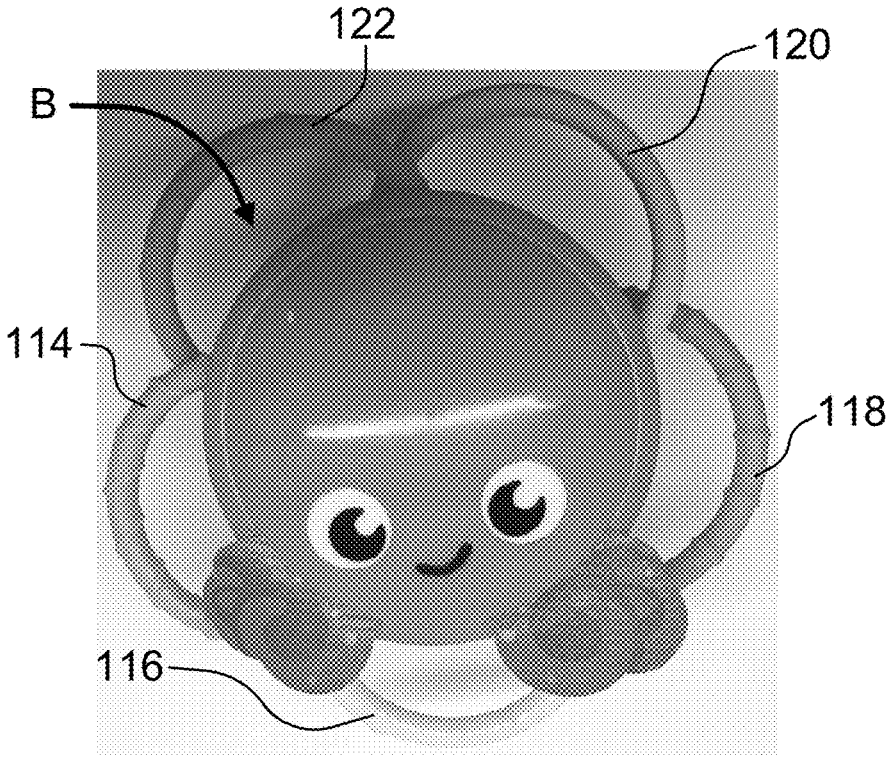
Figure 2D:
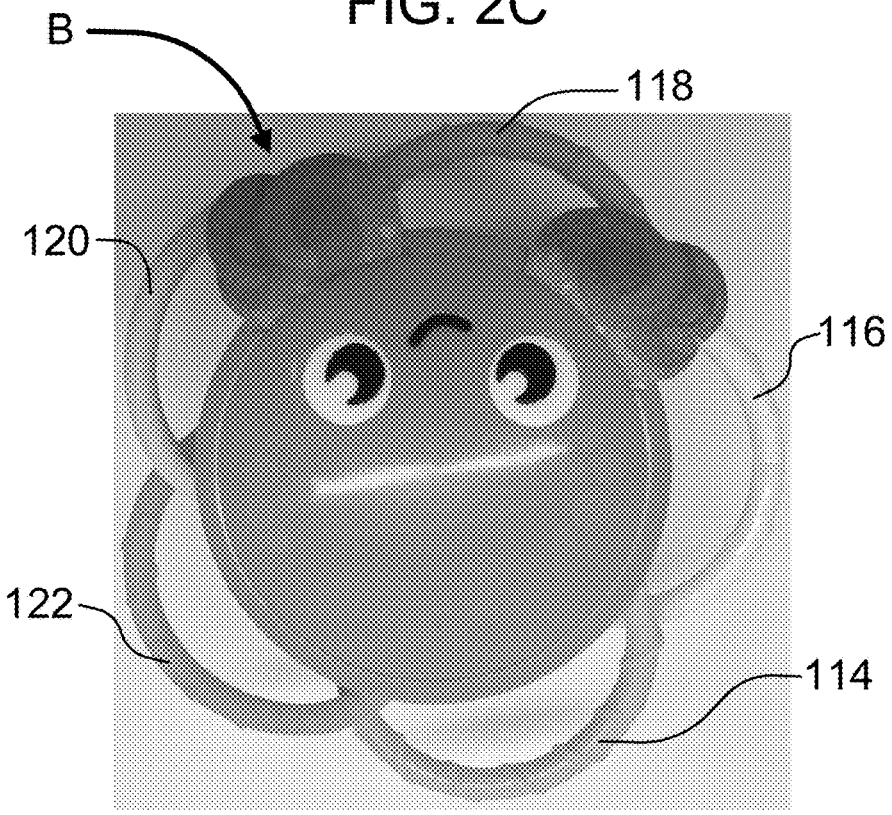

As shown in FIGS. 2C and 2D, the flexible rods 114-122 have flattened helical or ring-like shapes while the teething toy 100 is in the closed position B. This configuration allows the flexible rods 114-122 to protrude further out from the outer circumferences of the hubs 102, 108 and thus be more accessible for a child to chew on. In this configuration, the flexible rods 114-122 also provide handles or grips that the child can grab and hold onto. Additionally, the five flexible rods 114-122 form an aesthetically-pleasing flower pattern while the teething toy 100 is in the closed position B.

Referring back to FIG. 1D, the inner surfaces 106, 112 of the first and second hubs 102, 108 have an uneven or wave-like pattern. The inner surfaces 106, 112 are shaped such that when the first and second hubs 102, 108 are rotated, they complementarily engage with each other. Preferably, the inner surfaces 106, 112 are shaped such they complementarily engage with each other when the hubs 102, 108 are rotated in either direction (see, e.g., FIGS. 2A and 2B). Similar to the flexible rods 114-122, the uneven or wave-like pattern of the inner surfaces 106, 112 further prevents the hubs 102, 108 from engaging with each other if a child tries to push the hubs 102, 108 directly towards each other without any rotation.

In some instances, there may be safety concerns if the teething toy 100 is allowed to transform to a closed position without the hubs 102, 108 rotating. For example, the flexible rods may form thin closed loops that can become a choking hazard to children or create entrapment issues. Having the hubs 102, 108 twist and bend the flexible rods 114-122 into the wider ring-like configurations (see, e.g., FIGS. 2C and 2D) prevents individual flexible rods from entering and blocking a child's throat.

As shown in FIG. 2B, the teething toy 100 transforms from the closed position B to the open position A when the first and second hubs are pulled away from each other in the direction of the arrows D. This action disengages the inner surfaces 106, 112 of the first and second hubs 102, 108 and allows the resilient flexible rods 114-122 to return to their original shape. In the process, the first and second hubs 102, 108 rotate and become spaced apart.

Figure 3:
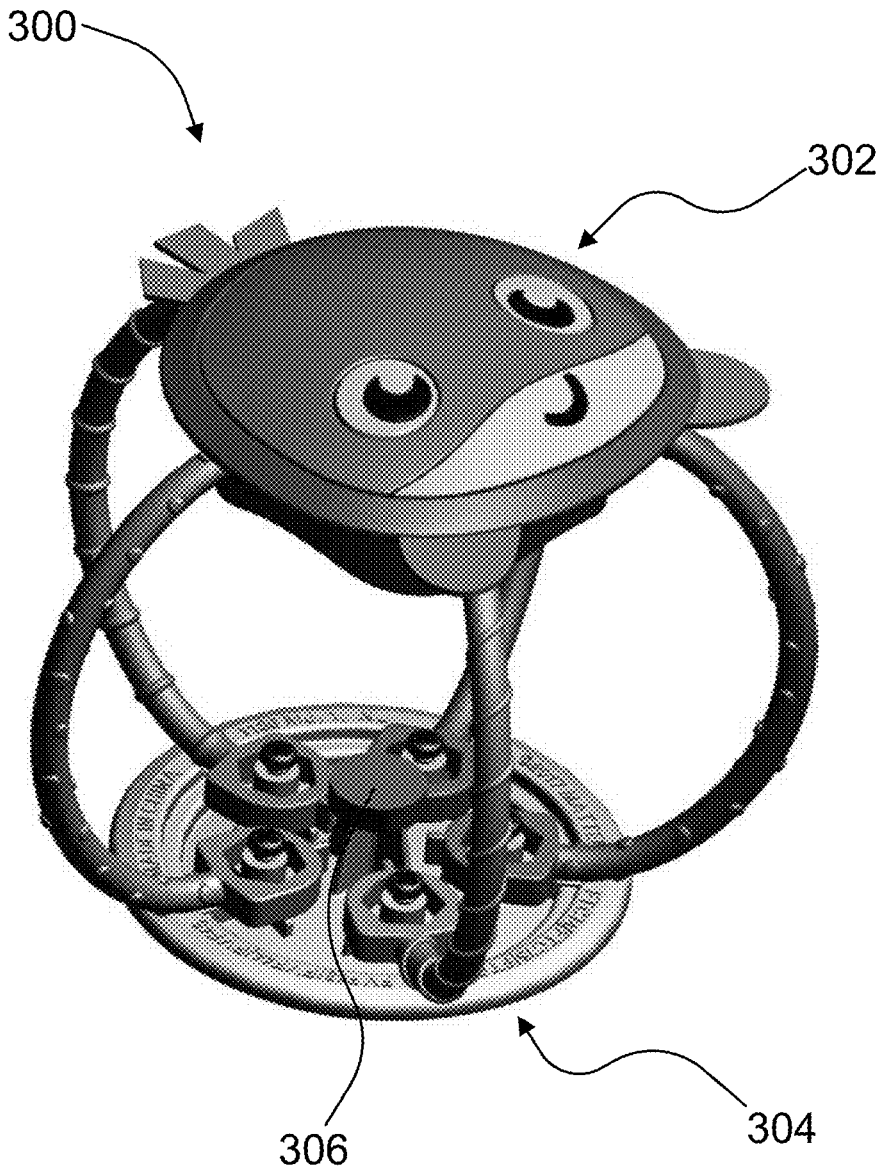
FIG. 3 illustrates a perspective view of a teething toy with an inner surface portion of the teething toy removed, in accordance with another embodiment of the invention.

In one or more embodiments, first hub 102 magnetically engages with the second hub 108 while in the closed position. FIG. 3 shows a teething toy 300 with an inner surface portion of a second hub 304 removed. The second hub 304 includes a magnet 306 underneath the removed inner surface. In one embodiment, the first hub 302 also includes a magnet (not shown) that engages with the magnet 306 in the second hub 304. In another embodiment, the first hub 302 includes a metal plate that engages with the magnet 306 in the second hub 304. Embodiments of the invention also include any other method of engaging or holding the hubs together. For example, the hubs may engage with each other through interlocking latches, male/female keyed tabs, receptacles, fabric hook and loop fasteners (e.g., VELCRO'), etc.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention.

Finally, various features from one of the embodiments may be incorporated into another of the embodiments. Accordingly, it is appropriate that the appended claims be construed broadly and in a manner consistent with the scope of the disclosure as set forth in the following claims.

The invention claimed is:

1. A transformable teething toy comprising:

a first hub and a second hub, each hub having an outer cover and an inner surface; and a plurality of resilient flexible rods connecting the first hub to the second hub such that the inner surface of the first hub is oriented to face towards the inner surface of the second hub, wherein the teething toy is transformable between an open position, where the first and second hubs are spaced apart from each other, and a closed position, where the inner surfaces of the first and second hubs are releasably engaged with each other, and wherein the plurality of resilient flexible rods cause the first hub and/or second hub to rotate as the teething toy transforms between the open and closed positions.

2. The transformable teething toy of claim 1, wherein the teething toy transforms from the open position to the closed position when the first and second hubs are pushed towards each other such that the inner surfaces of the first and second hubs engage with each other.

3. The transformable teething toy of claim 1, wherein the teething toy transforms from the closed position to the open position when the first and second hubs are pulled away from each other such that the inner surfaces of the first and second hubs disengage from each other, the first and second hubs being spaced apart by the resilient flexible rods.

4. The transformable teething toy of claim 1, wherein the resilient flexible rods are curved and the teething toy is a spherical or hemispherical structure in the open position.

5. The transformable teething toy of claim 1, wherein the inner surfaces of the first and second hubs complementarily engage with each other in the closed position.

6. The transformable teething toy of claim 1, wherein the first hub and/or the second hub comprises a magnet and the first hub magnetically engages with the second hub while in the closed position.

7. The transformable teething toy of claim 1, wherein the first and second hubs are circular and the resilient flexible rods connect to circumferences of the first and second hubs.

8. The transformable teething toy of claim 1, wherein the plurality of resilient flexible rods are five resilient flexible rods, each rod having a different surface texture.

9. A transformable teething toy comprising:

a first hub and a second hub, each hub having an outer cover and an inner surface; and a plurality of resilient flexible rods, each of the plurality of resilient flexible rods having a first end connected to the first hub and a second end connected to the second hub, wherein the teething toy is transformable between an open position, where the first and second hubs are spaced apart from each other by the plurality of resilient flexible rods to form an expanded structure, and a closed position, where the plurality of resilient flexible rods are bent such that the expanded structure is collapsed and the inner surfaces of the first and second hubs are releasably engaged with each other, and wherein the plurality of resilient flexible rods cause the first hub and/or second hub to rotate as the teething toy transforms between the open and closed positions.

10. The transformable teething toy of claim 9, wherein the teething toy transforms from the open position to the closed position when the first and second hubs are pushed towards each other such that the inner surfaces of the first and second hubs engage with each other.

11. The transformable teething toy of claim 9, wherein the teething toy transforms from the closed position to the open position when the first and second hubs are pulled away from each other such that the inner surface of the first hub is disengaged from the inner surface of the second hub.

12. The transformable teething toy of claim 9, wherein the inner surfaces of the first and second hubs complementarily engage with each other in the closed position.

13. The transformable teething toy of claim 9, wherein the first hub and/or the second hub comprises a magnet and the first hub magnetically engages with the second hub while in the closed position.

14. The transformable teething toy of claim 9, wherein the first and second hubs are circular, the first ends of the resilient flexible rods connect to a circumference of the first hub, and the second ends of the resilient flexible rods connect to a circumference of the second hub.

15. The transformable teething toy of claim 9, wherein the plurality of resilient flexible rods are five resilient flexible rods, each rod comprising a different surface texture.

16. A method of transforming a teething toy comprising:

providing a transformable teething toy comprising a first hub, a second hub, and a plurality of resilient flexible rods connecting the first hub to the second hub, the first and second hubs each having an outer cover and an inner surface; and transforming the teething toy by moving the first hub and second hub towards or away from each other to switch between an open position, where the first and second hubs are spaced apart from each other, and a closed position, where the inner surfaces of the first and second hubs are releasably engaged with each other, and wherein the plurality of resilient flexible rods cause the first hub and/or second hub to rotate while the teething toy is transformed between the open and closed positions.

17. The method of claim 16, wherein the inner surfaces of the first and second hubs complementarily engage with each other in the closed position.

* * * * *